US012781724B1

(12) United States Patent
Kwok et al.

(10) Patent No.: US 12,781,724 B1
(45) Date of Patent: Nov. 3, 2026

(54) FOUR-CYLINDER AIR COMPRESSOR

(71) Applicant: Mastery Investment LLC, Kowloon KLN (HK)

(72) Inventors: Daisy Lina Kwok, Kowloon KLN (HK); Jianjun Tan, Kowloon KLN (HK); Ye Lu, Kowloon KLN (HK)

(73) Assignee: Mastery Investment LLC, Kowloon KLN (HK)

( * ) Notice: Subject to any disclaimer, the term of this patent is extended or adjusted under 35 U.S.C. 154(b) by 0 days.

(21) Appl. No.: 19/354,944

(22) Filed: Oct. 10, 2025

(51) Int. Cl.

| | |
|---|---|
| ***F04B 27/02*** | (2006.01) |
| ***F01B 1/08*** | (2006.01) |
| ***F04B 35/04*** | (2006.01) |
| ***F04B 39/00*** | (2006.01) |
| ***F04B 39/06*** | (2006.01) |
| ***F04B 39/12*** | (2006.01) |

(52) U.S. Cl.
CPC ..... *F04B 27/02* (2013.01); *F01B 1/08* (2013.01); *F04B 35/04* (2013.01); *F04B 39/0044* (2013.01); *F04B 39/0094* (2013.01); *F04B 39/06* (2013.01); *F04B 39/123* (2013.01); *F04B 39/128* (2013.01)

(58) Field of Classification Search
CPC ..... F04B 25/00; F04B 25/005; F04B 27/02; F04B 35/04; F04B 39/0094; F01B 1/08; F01B 127/16; F02B 75/32; F02M 21/0218
USPC ..... 123/52.4, 52.6
See application file for complete search history.

(56) References Cited

U.S. PATENT DOCUMENTS

2009/0016917 A1* 1/2009 Smits ..... F01B 7/04 92/147
2023/0054192 A1* 2/2023 Tack ..... F04B 39/121

* cited by examiner

*Primary Examiner* — Kenneth J Hansen
(74) *Attorney, Agent, or Firm* — K&L Gates LLP

(57) ABSTRACT

The present disclosure relates to a four-cylinder air compressor comprising an electric motor, a first crankcase, and a second crankcase. The first crankcase houses a first crankshaft and a second crankshaft, while the second crankcase houses a third crankshaft and a fourth crankshaft. The first crankcase houses a first cylinder and a second cylinder, while the second crankcase houses a third cylinder and a fourth cylinder. When the motor operates, the first piston and the second piston perform synchronized reciprocating motion within the first cylinder and the second cylinder, respectively, in a first direction. The third piston and fourth piston reciprocate synchronously within the third and fourth cylinders, respectively, in a second direction; the first and second directions are opposite to each other; All four cylinders are charged with air, featuring a large airflow volume and significantly reduced charging time.

16 Claims, 2 Drawing Sheets

FOUR-CYLINDER AIR COMPRESSOR

TECHNICAL FIELD

The present disclosure relates to the field of air compressors, particularly to a four-cylinder air compressor.

BACKGROUND

With the advancement of modern society, vehicle usage has significantly increased, leading to a corresponding rise in the application of air compressors as central air sources. Passenger vehicles now require compressed air for an expanding range of functions, from air suspension systems to seat massage features, for example. Consequently, user demands for airflow capacity have also grown substantially. The duration of a single compressor operation has extended from mere minutes to hours, while expectations for compressor lifespan have also substantially increased. Furthermore, users increasingly prioritize quiet operation. Consequently, traditional passenger vehicle air compressors no longer meet these evolving demands, and a need therefore exists for an air compressor capable of handling increased airflow capacity demands reliably with quiet operation.

SUMMARY

To address the aforementioned shortcomings in conventional systems, the present disclosure provides a four-cylinder air compressor.

In a first aspect, which may be combined with any other aspect herein unless otherwise noted, a four-cylinder air compressor is provided. The fourt-cylinder air compressor comprises an electric motor, a first crankcase, and a second crankcase. The first crankcase houses a first crankshaft and a second crankshaft, while the second crankcase houses a third crankshaft and a fourth crankshaft. A first end and a second end of the output shaft of the electric motor is rotatably coupled to both the first crankcase and the second crankcase, respetively. The first crankcase houses a first cylinder and a second cylinder, while the second crankcase houses a third cylinder and a fourth cylinder. The first cylinder contains a first connecting rod and a first piston, the second cylinder contains a second connecting rod and a second piston, the third cylinder contains a third connecting rod and a third piston, and the fourth cylinder contains a fourth connecting rod and a fourth piston. A first end of the first connecting rod is rotatably coupled to the first crankshaft, while a second end of the first connecting rod is fixedly coupled to the first piston, wherein the first crankshaft is configured to cause driving of the first piston to reciprocate within the first cylinder; a first end of the second connecting rod is rotatably coupled to the second crankshaft, while a second end of the second connecting rod is fixedly coupled to the second piston, wherein the second crankshaft is configured to cause driving of the second piston to reciprocate within the second cylinder; a first end of the third connecting rod is rotatably coupled to the third crankshaft, while a second end of the third connecting rod is fixedly connected to the third piston, wherein the third crankshaft is configured to cause driving the third piston to reciprocate within the third cylinder; a first end of the fourth connecting rod is rotatably coupled to the fourth crankshaft, while a second end of the fourth connecting rod is fixedly coupled to the fourth piston, wherein the fourth crankshaft is configured to cause driving of the fourth piston to reciprocate within the fourth cylinder. When the motor operates, the first piston and the second piston reciprocate synchronously within the first cylinder and second cylinder, respectively, in a first direction, and the third piston and the fourth piston reciprocate synchronously within the third and fourth cylinders, respectively, in the second direction. The first direction is opposite to the second direction.

In a second aspect, which may be combined with any other aspect herein unless otherwise noted, when the first piston and second piston simultaneously retract to intake air within the first and second cylinders, the first direction refers to the first and second pistons moving toward each other in synchronization and gradually approaching. Simultaneously, the third piston and fourth piston compress and exhaust air within the third and fourth cylinders, respectively, where the second direction refers to the third piston and fourth piston moving in opposite directions in synchronization and gradually moving apart.

In a third aspect, which may be combined with any other aspect herein unless otherwise noted, when the first piston and second piston simultaneously compress and exhaust within the first and second cylinders, the first direction refers to the first and second pistons moving in opposite directions and gradually moving apart. The third piston and fourth piston simultaneously retract and intake within the third and fourth cylinders, the second direction refers to the third piston and fourth piston moving toward each other and gradually approaching.

In a fourth aspect, which may be combined with any other aspect herein unless otherwise noted, the configuration further includes connecting pipes. The upper ends of the connecting pipes are respectively connected to the exhaust ports of the first cylinder and third cylinder, while the lower ends are respectively connected to an intake port of the second cylinder and an intake port of the fourth cylinder.

In a fifth aspect, which may be combined with any other aspect herein unless otherwise noted, the configuration further includes intake ports and exhaust ports.

In a sixth aspect, which may be combined with any other aspect herein unless otherwise noted, the four-cylinder air compressor further includes a first pipe, a second pipe, a third pipe, and a fourth pipe. A first end of the first pipe couples to the intake port, and a second end of the first pipe couples to the intake end of the third cylinder. A first end of the second pipe couples to the exhaust end of the third cylinder, and a second end of the second pipe couples to the upper end of the connecting pipe. A first end of the third pipe couples to the lower end of the connecting pipe, and a second end of the third pipe couples to the intake end of the fourth cylinder. A first end of the fourth pipe is coupled to the exhaust end, while a second end of the fourth pipe is coupled to the exhaust port.

In a seventh aspect, which may be combined with any other aspect herein unless otherwise noted, it further includes a first auxiliary port and a second auxiliary port.

In an eighth aspect, which may be combined with any other aspect herein unless otherwise noted, the four-cylinder air compressor further comprises a housing, wherein the motor, first crankcase, and second crankcase are all accommodated within the housing.

In a ninth aspect, which may be combined with any other aspect herein unless otherwise noted, the material for manufacturing the housing includes aluminum, and it is integrally formed.

In a tenth aspect, which may be combined with any other aspect herein unless otherwise noted, a cross-sectional area of the first piston is greater than a cross-sectional area of the second piston, and a cross-sectional area of the third piston is greater than a cross-sectional area of the fourth piston.

In an eleventh aspect, which may be combined with any other aspect herein unless otherwise noted, a first containment chamber is provided between the first cylinder and an inner wall of the housing, a second containment chamber is provided between the second cylinder and the inner wall of the housing, a third containment chamber is provided between the third cylinder and the inner wall of the housing, and a fourth containment chamber is provided between the fourth cylinder and the inner wall of the housing. An opening of the first containment chamber faces the first cylinder, an opening of the second containment chamber faces the second cylinder, an opening of the third containment chamber faces the third cylinder, and an opening of the fourth containment chamber faces the fourth cylinder.

In a twelfth aspect, which may be combined with any other aspect herein unless otherwise noted, the four-cylinder air compressor further includes a first check valve assembly located within the first containment chamber and fixedly coupled to the inner wall of the housing, a second one-way valve assembly located within the second containment chamber and fixedly coupled to the inner wall of the housing, a third one-way valve assembly located within the third containment chamber and fixedly coupled to the inner wall of the housing, and a fourth one-way valve assembly located within the fourth containment chamber and fixedly coupled to the inner wall of the housing.

In a thirteenth aspect, which may be combined with any other aspect herein unless otherwise noted, the four-cylinder air compressor further comprises a first air inlet, a second air inlet, a first exhaust port, and a second exhaust port, wherein the first air inlet communicates with the first and third containment chambers via a passage within the housing, and the second air inlet communicates with the second and fourth containment chambers via a passage within the housing.

In a fourteenth aspect, which may be combined with any other aspect herein unless otherwise noted, the first exhaust port is connected via a passage within the housing to the exhaust passages of the first and third cylinders, while the second exhaust port is connected via a passage within the housing to the exhaust passages of the second cylinder and fourth cylinder.

In a fifteenth aspect, which may be combined with any other aspect herein unless otherwise noted, the four-cylinder air compressor further comprises a cooling device, which includes a pipe and a fluid flowing within the pipe.

In a sixteenth aspect, which may be combined with any other aspect herein unless otherwise noted, the four-cylinder air compressor further comprises a shock-absorbing pad mounted on the bottom of the housing.

In a seventeenth aspect, which may be combined with any other aspect herein unless otherwise noted, the four-cylinder air compressor further comprises a first fan and a second fan. The first fan is positioned at the end of the first crankcase remote from the motor, and the second fan is positioned at the end of the second crankcase remote from the motor.

In an eighteenth aspect, which may be combined with any other aspect herein unless otherwise noted, the four-cylinder air compressor further includes a first air guide hood and a second air guide hood, with the first fan positioned within the first air guide hood and the second fan positioned within the second air guide hood, wherein both the first and second air guide hoods are fixedly coupled to the housing.

The present disclosure offers the following advantages:

1) Two compression mechanisms are installed at both ends of the motor, totaling four compression cylinders. A single motor drives all four cylinders to compress air, enhancing operational efficiency;
(2) Since the two sets of cylinders alternate in supplying air to the user-meaning one set is always compressing and discharging air at any given moment—this achieves truly uninterrupted and stable air supply. Consequently, high-flow air can be delivered to the user in a short time, significantly boosting operational efficiency. Additionally, this alternating operation extends the service life of the air compressor; and
(3) The first piston in the first cylinder and the second piston in the second cylinder move reciprocally in the same direction, while the third piston in the third cylinder and the fourth piston in the fourth cylinder move reciprocally in the opposite direction. This counter-vector design, where the first direction opposes the second, substantially reduces overall vibration amplitude and noise levels, enhancing the user experience.

DETAILED DESCRIPTION

Figure 1:
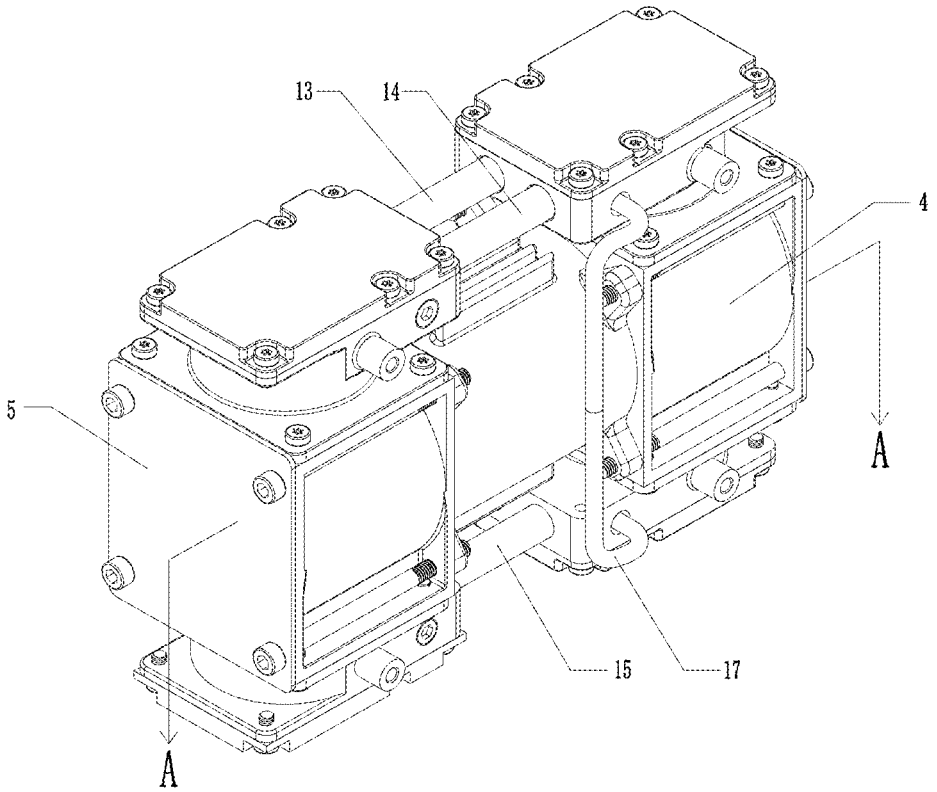
FIG. 1 is a front perspective view of a four-cylinder air compressor according to an example embodiment of the present disclosure.

In the Figures:

1 Motor; 2 First crankcase; 3 Second crankcase; 4 Housing; 5 Crankcase cover plate; 10 Output shaft;
11 Intake port; 12 Exhaust port; 13 First pipe; 14 Second pipe; 15 Third pipe; 16 Fourth pipe; 17 Connecting pipe; 18 First auxiliary port; 19 Second auxiliary port;
22 Second connecting rod; 23 Second piston; 24 First piston; 25 First connecting rod;
32 Fourth connecting rod; 33 Fourth piston; 34 Third connecting rod; 35 Third piston;
71 First cylinder; 72 Third cylinder; 81 Second cylinder; 82 Fourth cylinder.

Specific Implementation

To facilitate a clear understanding of the technical means, creative features, objectives, and effects achieved by the present disclosure, the following description further elaborates on the drawings with reference to specific embodiments.

As shown in FIGS. 1-4, the present disclosure provides a four-cylinder air compressor comprising an electric motor 1, a first crankcase 2, and a second crankcase 3. The first crankcase 2 houses a first crankshaft (not shown) and a second crankshaft (not shown), while the second crankcase 3 houses a third crankshaft (not shown) and a fourth crankshaft (not shown). The output shaft 10 of motor 1 is rotatably coupled to both ends of first crankcase 2 and second crankcase 3, respectively. The first crankcase 2 houses a first cylinder 71 and a second cylinder 81, while the second crankcase 3 houses a third cylinder 72 and a fourth cylinder 82. The first cylinder 71 contains a first connecting rod 25 and a first piston 24, and the second cylinder 81 contains a second connecting rod 22 and a second piston 23. The third cylinder 72 houses a third connecting rod 34 and a third piston 35, while the fourth cylinder 82 contains a fourth connecting rod 32 and a fourth piston 33. One end of the first connecting rod 25 is rotatably coupled to the first crankshaft, and the other end is coupled to the first piston 24 with at least one degree of motion such that the first piston 24 is able to move back and forth within the cylinder without fracturing the connecting rod 25 (such as by a pinned connection), driving the first piston 24 to reciprocate within the first cylinder 71. One end of the second connecting rod 22 is rotatably coupled to the second crankshaft, while the other end is coupled to the second piston 23 with at least one degree of motion such that the second piston 23 is able to move back and forth within the cylinder without fracturing the connecting rod 22 (such as by a pinned connection), driving the second piston 23 to reciprocate within the second cylinder 81. One end of the third connecting rod 34 is rotatably coupled to the third crankshaft, while the other end is coupled to the third piston 35 with at least one degree of motion such that the third piston 35 is able to move back and forth within the cylinder without fracturing the connecting rod 34 (such as by a pinned connection), driving the third piston 35 to reciprocate within the third cylinder 72. One end of the fourth connecting rod 32 is rotatably coupled to the fourth crankshaft, while the other end is coupled to the fourth piston 33 with at least one degree of motion such that the fourth piston 33 is able to move back and forth within the cylinder without fracturing the connecting rod 32 (such as by a pinned connection), driving the fourth piston 33 to reciprocate within the fourth cylinder 82. When the motor 1 operates, two compression mechanisms are installed at each end of the motor 1, totaling four compression cylinders. A single motor 1 drives all four compression cylinders to compress air, significantly enhancing operational efficiency.

The cross-sectional area of the first piston 24 is larger than that of the second piston 23, and the cross-sectional area of the third piston 35 is larger than that of the fourth piston 33. Therefore, this four-cylinder air compressor can not only perform single-stage compression to provide low-pressure gas but also perform two-stage gas compression as needed to meet requirements, thereby expanding its application range.

The output shaft 10 of the motor 1 connects to both the first crankcase 2 and the second crankcase 3. When the motor 1 starts, it drives the first crankshaft, second crankshaft, third crankshaft, and fourth crankshaft to rotate via the output shaft 10. In some embodiments, the output shaft 10 may comprise one or more crankwebs (corresponding to each of the pistons), such that a separate crankshaft is unnecessary.

The rotation of the first crankshaft drives the first connecting rod 25 to rotate, which in turn pushes the first piston 24 to reciprocate within the first cylinder 71, thereby compressing the gas inside the first cylinder 71. The rotation of the second crankshaft drives the second connecting rod 22 to rotate, pushing the second piston 23 to reciprocate within the second cylinder 81, thereby compressing the gas inside the second cylinder 81.

Similarly, when the third crankshaft rotates, it drives the third connecting rod 34 to rotate. The third connecting rod 34 pushes the third piston 35 to reciprocate within the third cylinder 72, thereby compressing the gas inside the third cylinder 72. When the fourth crankshaft rotates, it drives the fourth connecting rod 32 to rotate. The fourth connecting rod 32 pushes the fourth piston 33 to reciprocate within the fourth cylinder 82, thereby compressing the gas inside the fourth cylinder 82.

As shown in FIGS. 1-4, the first cylinder 71 and second cylinder 81 are located on the left side of this air compressor in the angles shown. When the motor 1 operates, the first piston 24 and second piston 23 perform synchronized reciprocating motion within the first cylinder 71 and second cylinder 81, respectively. Whether during intake or compression, this causes vibration throughout the entire air compressor. Similarly, the third cylinder 72 and fourth cylinder 82 are positioned on the right side of the air compressor in the angles shown. When the motor 1 operates, the third piston 35 and fourth piston 33 move reciprocally in the third cylinder 72 and fourth cylinder 82, respectively, in synchronized motion. Whether during suction or compression, this causes vibration throughout the entire air compressor.

Figure 4:
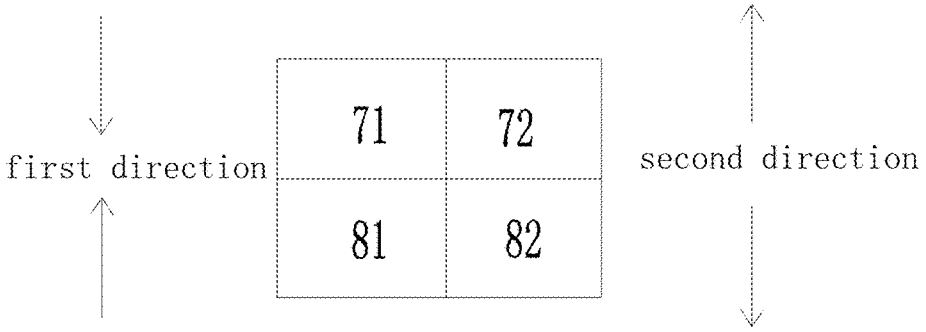
FIG. 4 is a schematic diagram showing synchronous movement of the cylinders on both sides of the four-cylinder air compressor according to an example embodiment of the present disclosure.

As used herein with respect to FIG. 4, the direction of synchronous reciprocating motion of the first piston 24 within the first cylinder 71 and the second piston 23 within the second cylinder 81 constitutes the first direction. The direction of synchronous reciprocating motion of the third piston 35 within the third cylinder 72 and the fourth piston 33 within the fourth cylinder 82 constitutes the second direction, which is opposite to the first direction. As shown in FIG. 4, for example, the term direction can be used to describe motion toward a center of the air compressor (as in the case of the first direction) or away from the center of the air compressor (as in the case of the second direction).

As shown in FIG. 4, when the motor 1 operates, during synchronous suction contraction of the first piston 24 within the first cylinder 71 and the second piston 23 within the second cylinder 81, the first direction occurs—the first and second pistons move toward each other in synchronous opposition. The third piston 35 in the third cylinder 72 and the fourth piston 33 in the fourth cylinder 82 simultaneously compress and exhaust the air in their respective cylinders 72, 82. The second direction represents the third piston 35 and fourth piston 33 moving synchronously in opposite directions (counter-rotating motion) and gradually moving apart; the first direction is opposite to the second direction.

Figure 5:
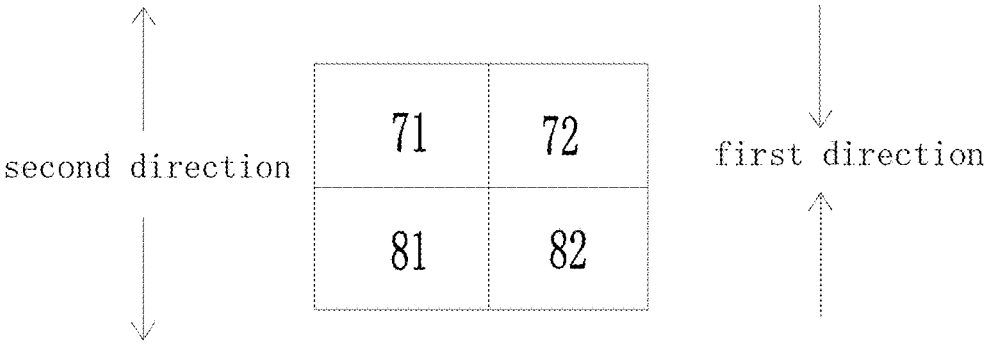
FIG. 5 is a schematic diagram showing another state of synchronous movement of the cylinders on both sides of the four-cylinder air compressor according to an example embodiment of the present disclosure.

As shown in FIG. 5, when the first piston 24 and the second piston 23 simultaneously compress and exhaust the air within the first cylinder 71 and the second cylinder 81 respectively, the second direction occurs: the first piston 24 and the second piston 23 move synchronously in opposite directions and gradually move apart. When the third piston 35 in the third cylinder 72 and the fourth piston 33 in the fourth cylinder 82 synchronously retract to intake air, the first direction occurs, involving the third piston 35 and fourth piston 33 moving synchronously toward each other and gradually approaching. The first direction is once again opposite to the second direction.

Under these conditions, the synchronous movement of the first piston 24 within the first cylinder 71 and the second piston 23 within the second cylinder 81 causes vibration in the air compressor. The third piston 35 and fourth piston 33 move synchronously within the third cylinder 72 and fourth cylinder 82 respectively, inducing vibration in the air compressor. These two vibrations have opposite directions, employing a 180-degree counter-phase vector design. Their energies cancel each other out, resulting in minimal overall vibration and extremely low noise levels for the air compressor, significantly enhancing user experience.

Traditional single- or dual-cylinder air compressors deliver intermittent air supply to users. This occurs because they require a period of intake followed by compression before dispensing air, resulting in non-continuous air delivery. Consequently, the filling process consumes considerable time and exhibits low operational efficiency.

In this embodiment, when the motor 1 operates, the first piston 24 within the first cylinder 71 and the second piston 23 within the second cylinder 81 move reciprocally in the same direction. Meanwhile, the third piston 35 within the third cylinder 72 and the fourth piston 33 within the fourth cylinder 82 move reciprocally in the opposite direction.

In this embodiment, when the first cylinder 71 and second cylinder 81 perform compression and exhaust to inflate the desired pneumatic system, the third cylinder 72 and fourth cylinder 82 perform contraction and suction operations. Conversely, when the first cylinder 71 and second cylinder 81 contract and suck in air, the third cylinder 72 and fourth cylinder 82 perform compression and exhaust to inflate the desired pneumatic system. In other words, the two sets of cylinders alternately inflate the pneumatic system. At any given moment, one set of cylinders is performing the compression and exhaust action to inflate the pneumatic system, achieving truly uninterrupted inflation. This enables high-flow inflation of the pneumatic system within a short time, significantly improving work efficiency. On the other hand, because the two sets of cylinders alternately inflate the pneumatic system, the service life of this air compressor is also extended, as each set of cylinders only needs to perform half as much work compared to if each set of cylinders were responsible for providing compressed air (and each cylinder only needs to perform a quarter of the amount of work compared to single-cylinder air compressors).

In this embodiment, the air compressor further includes connecting pipes 17. The upper ends of each of the connecting pipes 17 are fluidly connected to the exhaust ports of the first cylinder 71 and the third cylinder 72, respectively, while the lower ends of each of the connecting pipes 17 are fluidly connected to the intake ports of the second cylinder 81 and the fourth cylinder 82, respectively. Specifically, the first cylinder 71 and third cylinder 72 function as the first-stage compression cylinders. After compressing the air, the discharged gas flows through each connecting pipe 17 into the next-stage cylinders (the second cylinder 81 and fourth cylinder 82) for secondary compression, thereby achieving the high-pressure gas required by the user.

In this embodiment, the air compressor further includes an intake port 11 and an exhaust port 12. Additionally, the air compressor comprises a first pipe 13, a second pipe 14, a third pipe 15, and a fourth pipe 16. One end of the first pipe 13 connects to the intake port 11, while the other end connects to the intake port of the third cylinder 72. One end of the second pipe 14 connects to the exhaust port of the third cylinder 72, while the other end connects to the upper end of the connecting pipe 17. One end of the third pipe 15 connects to the lower end of the connecting pipe 17, while the other end connects to the intake port of the fourth cylinder 82. One end of the fourth pipe 16 connects to the exhaust port of the second cylinder 81, while the other end connects to the exhaust port 12.

Figure 2:
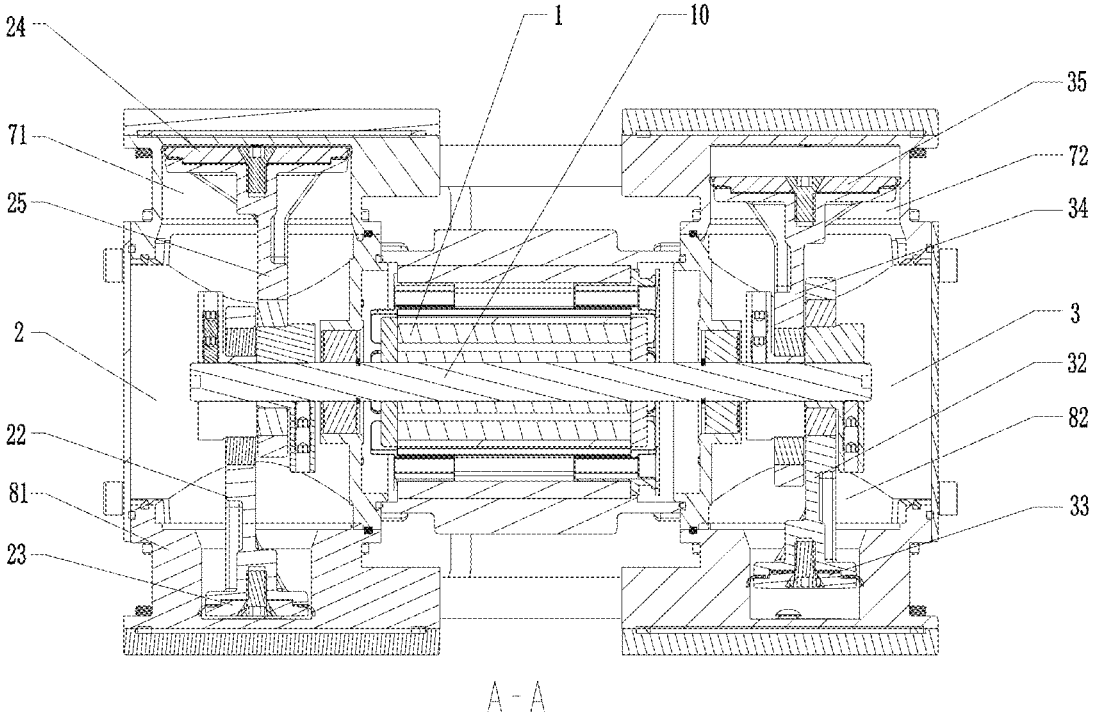
FIG. 2 is a sectional view along line A-A of FIG. 1.
Figure 3:
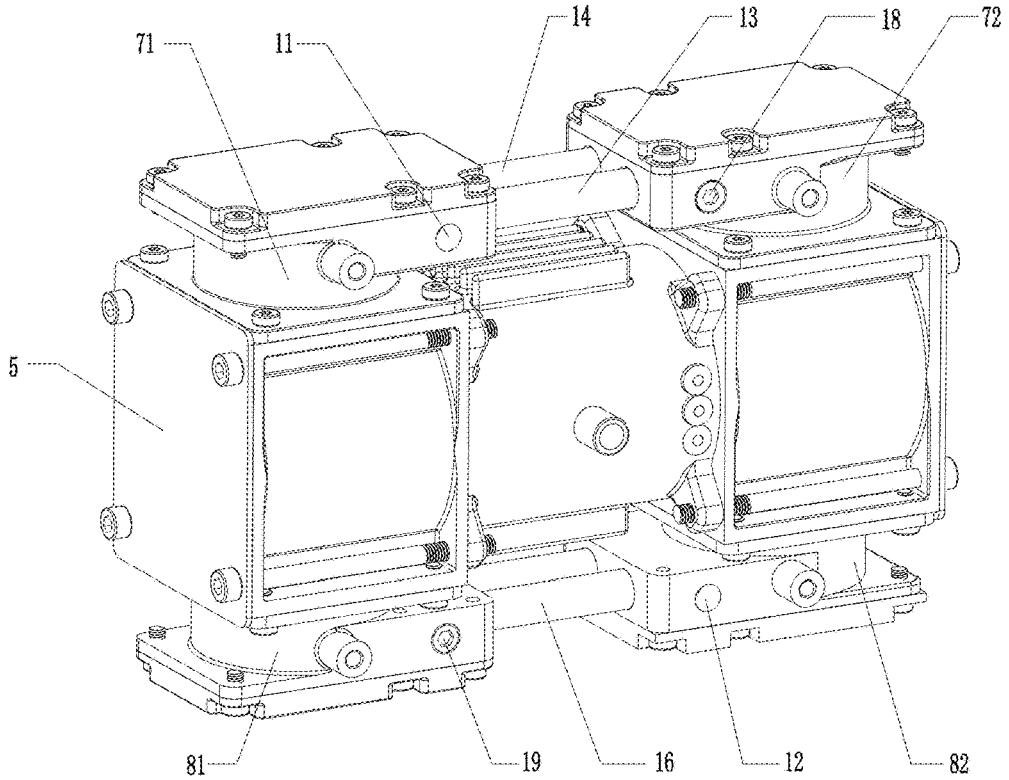
FIG. 3 is a rear perspective view of the four-cylinder air compressor of FIG. 1.

As shown in FIGS. 1-3, on one hand, air enters the first cylinder 71 through the intake port 11. The compressed gas is then discharged and sequentially flows through the connecting pipe 17 and the third pipe 15 into the fourth cylinder 82. After secondary compression, it is discharged through the exhaust port 12.

On the other hand, air enters the third cylinder 72 through the inlet port 11 and the first pipe 13. The compressed gas is discharged and sequentially enters the second cylinder 81 via the second pipe 14 and connecting pipe 17. After secondary compression, it is sequentially discharged through the fourth pipe 16 and exhaust port 12.

In other words, air is compressed in the primary compression cylinder and then enters the secondary cylinder on the opposite side through various pipes for secondary compression, thereby producing the high-pressure gas required by some pneumatic systems.

Furthermore, the air compressor includes a first standby port 18 and a second standby port 19, both normally sealed. These can be reactivated when needed for contingency purposes. Preferably, the first standby port 18 can serve as an alternative intake port, while the second standby port 19 can function as an alternative exhaust port.

The air compressor further includes a housing 4, wherein the motor 1, first crankcase 2, and second crankcase 3 are all accommodated within housing 4. In some embodiments, the material for manufacturing housing 4 includes aluminum, and it is integrally formed.

In some embodiments, a crankcase cover plate 5 is also included. This crankcase cover plate 5 is fixedly coupled to housing 4 to protect the crankcase from external interference.

In some embodiments, a first containment chamber (not shown) is provided between the first cylinder 71 and the inner wall of the housing 4. A second containment chamber (not shown) is provided between the second cylinder 81 and the inner wall of the housing 4. A third containment chamber (not shown) is provided between the third cylinder 72 and the inner wall of the housing 4. A fourth containment chamber (not shown) is provided between the fourth cylinder 82 and the inner wall of the housing 4. The opening of the first containment chamber faces the first cylinder 71, the opening of the second containment chamber faces the second cylinder 81, the opening of the third containment chamber faces the third cylinder 72, and the opening of the fourth containment chamber faces the fourth cylinder 82.

In some embodiments, a one-way valve assembly is mounted within each containment chamber and fixedly coupled to the inner wall of the housing 4, positioned near the inlet of each cylinder. This one-way valve assembly may include a valve plate and a spring plate pressed against the valve plate, among other components, which are not described in detail herein but will be appreciated by those skilled in the art.

The first one-way valve assembly (not shown) is located within the first containment chamber and fixedly connected to the inner wall of the housing 4. The second one-way valve assembly (not shown) is located in the second housing chamber and fixedly connected to the inner wall of the housing 4. The third one-way valve assembly (not shown) is located in the third housing chamber and fixedly connected to the inner wall of the housing 4. The fourth one-way valve assembly (not shown) is located in the fourth housing chamber and fixedly connected to the inner wall of the housing 4. That is, each one-way valve assembly corresponds one-to-one with each respective cylinder.

Conventional air compressors are arranged to have at least one intake port and at least one exhaust port for each cylinder. In contrast, the air compressor according to the present disclosure, comprising four cylinders, requires only one intake port and one exhaust port. This configuration saves material and processing costs while improving efficiency.

Additionally, to prevent heat accumulation from affecting the performance of this four-cylinder air compressor, a cooling device (not shown) is provided in some embodiments. This cooling device comprises a pipe in thermal contact with the air compressor and a fluid flowing within the pipe. By circulating the fluid through the pipe, heat is dissipated from the air compressor to the fluid, thereby achieving the effect of cooling and lowering the temperature of the heat-generating areas, improving heat dissipation efficiency. Furthermore, in some embodiments a vibration damping pad (not shown) is installed at the bottom of the housing 4 to reduce operational noise.

Additionally, in some embodiments a first fan (not shown) is positioned at the end of the first crankcase 2 opposite the motor 1, while a second fan (not shown) is located at the end of the second crankcase 3 opposite the motor 1. Preferably, the first fan and second fan are mounted at opposite ends of the output shaft 10 of the motor 1. When the motor 1 is activated, it drives the first and second fans to rotate, accelerating airflow within the housing 4 and further enhancing heat dissipation efficiency.

Additionally, in some embodiments the air compressor comprises a first air guide hood (not shown) and a second air guide hood (not shown). The first fan is positioned within the first air guide hood, and the second fan is positioned within the second air guide hood. Both the first and second air guide hoods are fixedly coupled to the housing.

Although the present disclosure has been described in detail above through general descriptions and specific embodiments, modifications or improvements based on the disclosure will be apparent to those skilled in the art. Therefore, such modifications or improvements made without departing from the spirit of the disclosure are within the scope of the disclosure as claimed.

The invention claimed is:

1. A four-cylinder air compressor, comprising:

an electric motor;

a first crankcase; and a second crankcase, wherein the first crankcase is provided with a first crankshaft and a second crankshaft, and the second crankcase is provided with a third crankshaft and a fourth crankshaft, wherein an output shaft of the electric motor is rotatably coupled at a first end and a second end to the first crankcase and the second crankcase, respectively, wherein the first crankcase houses a first cylinder and a second cylinder, while the second crankcase houses a third cylinder and a fourth cylinder, wherein the first cylinder contains a first connecting rod and a first piston, the second cylinder contains a second connecting rod and a second piston, the third cylinder contains a third connecting rod and a third piston, and the fourth cylinder contains a fourth connecting rod and a fourth piston, wherein a first end of the first connecting rod is rotatably coupled to the first crankshaft, while a second end of the first connecting rod is fixedly coupled to the first piston, wherein the first crankshaft is configured to cause driving of the first piston to reciprocate within the first cylinder, wherein a first end of the second connecting rod is rotatably coupled to the second crankshaft, while a second end of the second connecting rod is fixedly coupled to the second piston, wherein the second crankshaft is configured to cause driving of the second piston to reciprocate within the second cylinder, wherein a first end of the third connecting rod is rotatably coupled to the third crankshaft, while a second end of the third connecting rod is fixedly coupled to the third piston, wherein the third crankshaft is configured to cause driving of the third piston to reciprocate within the third cylinder, wherein a first end of the fourth connecting rod is rotatably coupled to the fourth crankshaft, while a second end of the fourth crankshaft is fixedly coupled to the fourth piston, wherein the fourth crankshaft is configured to cause driving of the fourth piston to reciprocate within the fourth cylinder, and wherein when the electric motor operates, the first piston and the second piston perform synchronized reciprocating motion within the first cylinder and the second cylinder, respectively, in a first direction, and the third piston reciprocates within the third cylinder, and the fourth piston reciprocates within the fourth cylinder, both moving in a second direction, wherein the first direction is opposite to the second direction.

2. The four-cylinder air compressor according to claim 1, wherein when the first piston in the first cylinder and the second piston in the second cylinder synchronously retract to draw in air, the first direction refers to the first piston and second piston moving synchronously toward each other and gradually approaching, and the third piston in the third cylinder and the fourth piston in the fourth cylinder simultaneously compress and exhaust air, with the second direction being the third piston and fourth piston moving synchronously in opposite directions and gradually moving apart.

3. The four-cylinder air compressor according to claim 2, wherein when the first piston in the first cylinder and the second piston in the second cylinder simultaneously compress and exhaust air, the first direction involves the first piston and the second piston moving synchronously in opposite directions and gradually moving apart, and the third piston in the third cylinder and the fourth piston in the fourth cylinder simultaneously retract to draw in air, with the second direction being to the third piston and fourth piston moving toward each other in a synchronized manner while gradually approaching one another.

4. The four-cylinder air compressor according to claim 1, further comprising a connecting pipe, wherein an upper end of the connecting pipe is connected to an exhaust port of the first cylinder and an exhaust port of the third cylinder, respectively, and a lower end of the connecting pipe is connected to an intake port of the second cylinder and an intake port of the fourth cylinder, respectively.

5. The four-cylinder air compressor according to claim 1, further comprising an intake port and an exhaust port.

6. The four-cylinder air compressor according to claim 5, further comprising:

a first pipe;

a second pipe;

a third pipe; and a fourth pipe, wherein a first end of the first pipe is coupled to the intake port, and a second end of the first pipe is coupled to an intake end of the third cylinder, wherein a first end of the second pipe is coupled to an exhaust end of the third cylinder, and a second end of the second pipe connected to an upper end of a connecting pipe, wherein a first end of the third pipe is coupled to a lower end of the connecting pipe, and a second end of the third pipe is connected to an intake end of the fourth cylinder, wherein a first end of the fourth pipe is coupled to an exhaust end of the fourth cylinder, and a second end of the fourth pipe is connected to the exhaust port.

7. The four-cylinder air compressor according to claim 1, further comprising a first auxiliary port and a second auxiliary port.

8. The four-cylinder air compressor according to claim 1, further comprising a housing, wherein the electric motor, the first crankcase, and the second crankcase are all accommodated within the housing.

9. The four-cylinder air compressor according to claim 8, wherein a material for manufacturing the housing includes aluminum, and the housing is manufactured as an integral piece.

10. The four-cylinder air compressor according to claim 1, wherein a cross-sectional area of the first piston is greater than a cross-sectional area of the second piston, and a cross-sectional area of the third piston is greater than a cross-sectional area of the fourth piston.

11. The four-cylinder air compressor according to claim 1, wherein a first containment chamber is provided between the first cylinder and an inner wall of a housing, a second containment chamber is provided between the second cylinder and the inner wall of the housing, a third containment chamber is provided between the third cylinder and the inner wall of the housing, and a fourth containment chamber is provided between the fourth cylinder and the inner wall of the housing, and wherein an opening of the first containment chamber faces the first cylinder, an opening of the second containment chamber faces the second cylinder, an opening of the third containment chamber faces the third cylinder, and an opening of the fourth containment chamber faces the fourth cylinder.

12. The four-cylinder air compressor as claimed in claim 11, further comprising:

a first check valve assembly located within the first containment chamber and fixedly coupled to the inner wall of the housing;

a second check valve assembly located within the second containment chamber and fixedly coupled to the inner wall of the housing;

a third one-way valve assembly located within the third containment chamber and fixedly coupled to the inner wall of the housing; and a fourth one-way valve assembly, located within the fourth containment chamber and fixedly coupled to the inner wall of the housing.

13. The four-cylinder air compressor according to claim 1, further comprising a cooling device, wherein the cooling device includes a pipe and a fluid flowing within the pipe.

14. The four-cylinder air compressor according to claim 1, further comprising a vibration damping pad mounted at a bottom of a housing.

15. The four-cylinder air compressor according to claim 1, further comprising a first fan and a second fan, wherein the first fan is disposed at an end of the first crankcase remote from the electric motor and the second fan is disposed at an end of the second crankcase remote from the electric motor.

16. The four-cylinder air compressor according to claim 15, further comprising a first air guide hood and a second air guide hood, wherein the first fan is disposed within the first air guide hood, the second fan is disposed within the second air guide hood, and both the first air guide hood and the second air guide hood are fixedly coupled to a housing.

* * * * *